US007985086B1

(12) United States Patent
Sun

(10) Patent No.: US 7,985,086 B1
(45) Date of Patent: Jul. 26, 2011

(54) MOUNTING APPARATUS FOR EXPANSION CARD

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/880,167

(22) Filed: Sep. 13, 2010

(30) Foreign Application Priority Data

May 17, 2010 (CN) ..... 2010 10 173815

(51) Int. Cl.
*H01R 13/62* (2006.01)

(52) U.S. Cl. ..... 439/157; 439/328

(58) Field of Classification Search ..... 439/157, 439/159, 160, 325–328, 637
See application file for complete search history.

(56) References Cited

U.S. PATENT DOCUMENTS

| | | | | |
|---|---|---|---|---|
| 4,872,853 | A * | 10/1989 | Webster | 439/327 |
| 5,417,580 | A * | 5/1995 | Tsai | 439/328 |
| 6,948,957 | B1 * | 9/2005 | Costello et al. | 439/157 |
| 7,252,523 | B1 * | 8/2007 | Pennypacker et al. | 439/160 |
| 7,661,974 | B1 * | 2/2010 | Sun | 439/328 |

* cited by examiner

*Primary Examiner* — Thanh-Tam T Le
(74) *Attorney, Agent, or Firm* — Zhigang Ma

(57) ABSTRACT

An exemplary mounting apparatus includes a connector and two latching mechanisms connected to two opposite ends of the connector. The connector defines a slot in a top surface thereof, and two sliding grooves in two opposite side surfaces thereof. Each sliding groove extends though the two side surfaces. Each latching mechanisms includes a guide pin and a latching member. The guide pin is slidably received in a corresponding sliding groove. The latching member includes a latching portion for engaging with an expansion card, two feet connected to two ends of the guide pin, and two connecting arms each connected between one end of the latching portion and a corresponding foot. When the guide pin is pulled by the latching member to move from a bottom end to a top end of the sliding groove, the expansion card is pushed out of the slot of the connector by the guide pin.

20 Claims, 8 Drawing Sheets

MOUNTING APPARATUS FOR EXPANSION CARD

BACKGROUND

1. Technical Field

The disclosure generally relates to mounting apparatuses; and more particularly to a mounting apparatus for an expansion card.

2. Description of Related Art

Generally, an expansion card such as a memory card is fixed on a circuit board of an electronic device by a mounting apparatus. The electronic device may for example be a computer or a server. The mounting apparatus includes an electrical connector, and two plate-shaped locking members disposed at two opposite ends of the connector for clamping two opposite ends of the expansion card. However, the plate-shaped locking members may block airflow to the expansion card. In particular, a circuit board may have a plurality of expansion cards fixed thereon, with the expansion cards parallel and adjacent to each other. In this arrangement, the locking members of the mounting apparatuses block air from flowing into and out of a space between each two adjacent expansion cards. This reduces the efficiency of dissipation of heat from the expansion cards.

What is needed, therefore, is a means to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead placed upon clearly illustrating the principles of the present embodiments. Moreover, in the drawings, like reference numerals designate corresponding parts throughout the several views.

DETAILED DESCRIPTION

Figure 1:
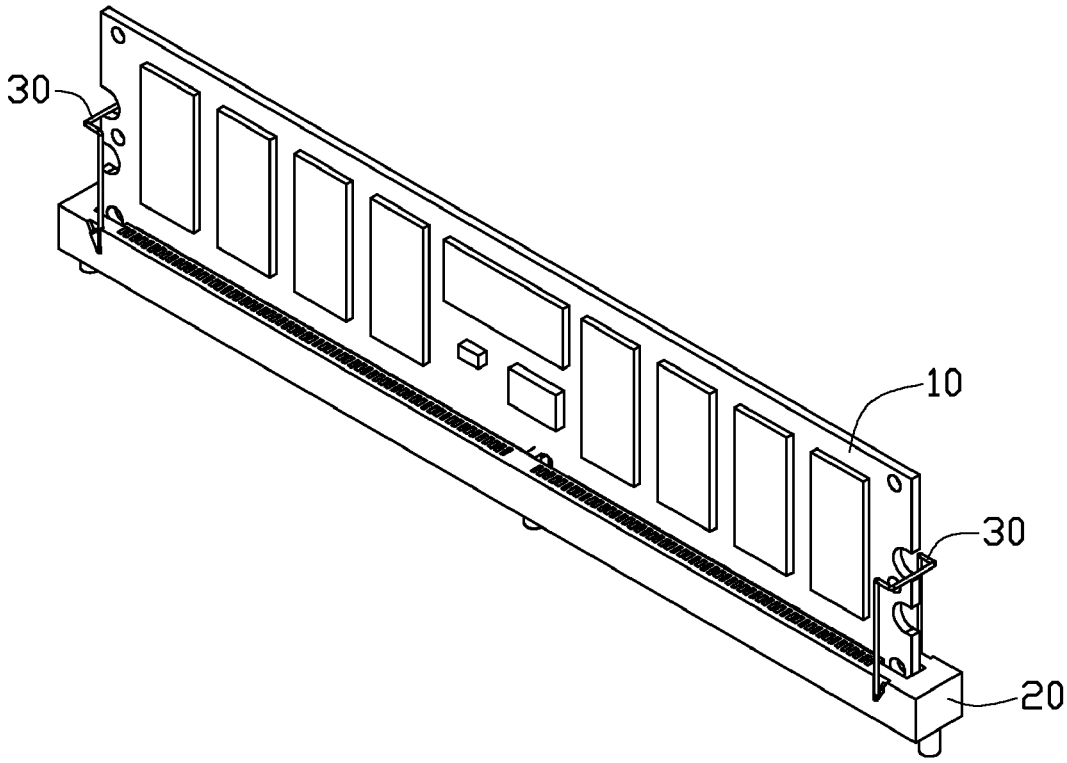
FIG. 1 is an isometric, assembled view of a mounting apparatus in accordance with an exemplary embodiment of the present disclosure, together with an expansion card mounted thereon.
Figure 2:
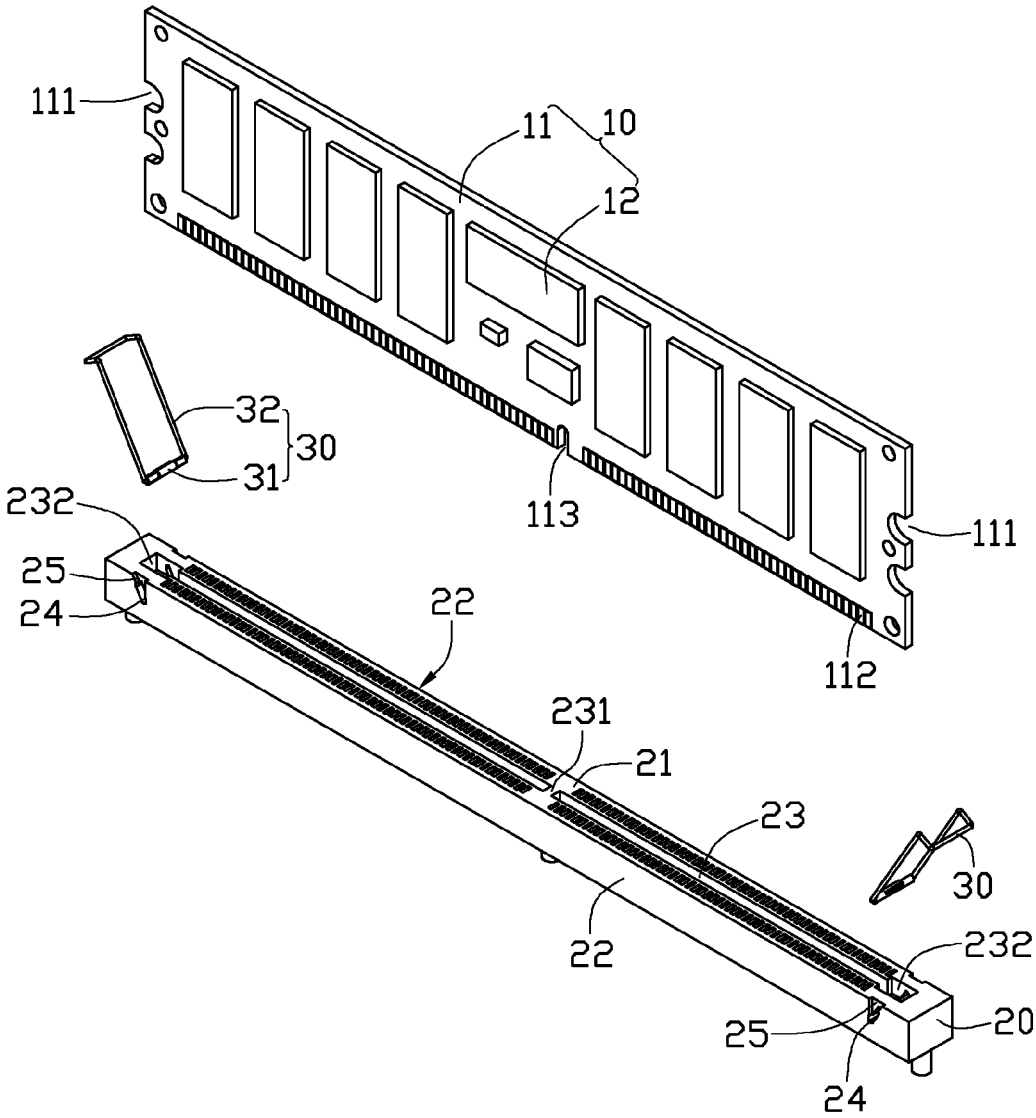
FIG. 2 is an exploded view of FIG. 1.

Referring to FIGS. 1-2, a mounting apparatus according to an exemplary embodiment of the present disclosure is shown. The mounting apparatus is used for mounting an expansion card 10 thereon. The mounting apparatus includes an electrical connector 20, and two latching mechanisms 30 respectively arranged at two opposite ends of the connector 20. The connector 20 is installed on a mainboard (not shown) to electrically connect the expansion card 10 with the mainboard.

The expansion card 10 includes an elongated main body 11, and a plurality of chips 12 mounted on the main body 11. The main body 11 of the expansion card 10 has two opposite ends, and two spaced arc-shaped recesses 111 defined in each end thereof. A plurality of horizontally spaced electrical pins 112 are provided on a bottom portion of the expansion card 10.

The connector 20 is elongated, and includes two long sidewalls (not labeled) parallel to each other. The connector 20 includes a top surface 21, and two opposite side surfaces 22 extending downwardly from two opposite sides of the top surface 21. The side surfaces 22 are parts of the sidewalls, respectively. A slot 23 is defined in the top surface 21 of the connector 20, and extends along a longitudinal direction of the connector 20. A block 231 is formed in the slot 23 to divide the slot 23 into two portions. The bottom portion of the expansion card 10 defines a cutout 113 therein corresponding to the block 231. The bottom portion of the expansion card 10 can be inserted into the slot 23 of the connector 20 only when the cutout 113 is aligned with the block 231 in a correct orientation. The connector 20 has a plurality of electrical terminals (not shown) in the slot 23, corresponding to the pins 112 of the expansion card 10. When the bottom portion of the expansion card 10 is inserted into the slot 23 of the connector 20, the terminals of the connector 20 contact the pins 112 of the expansion card 10 to electrically connect the expansion card 10 with the mainboard. Two receiving grooves 232 are defined in the top surface 21 of the connector 20, and are respectively located at two opposite ends of the slot 23. A transverse width of each receiving groove 232 is broader than that of the slot 23.

Figure 3:
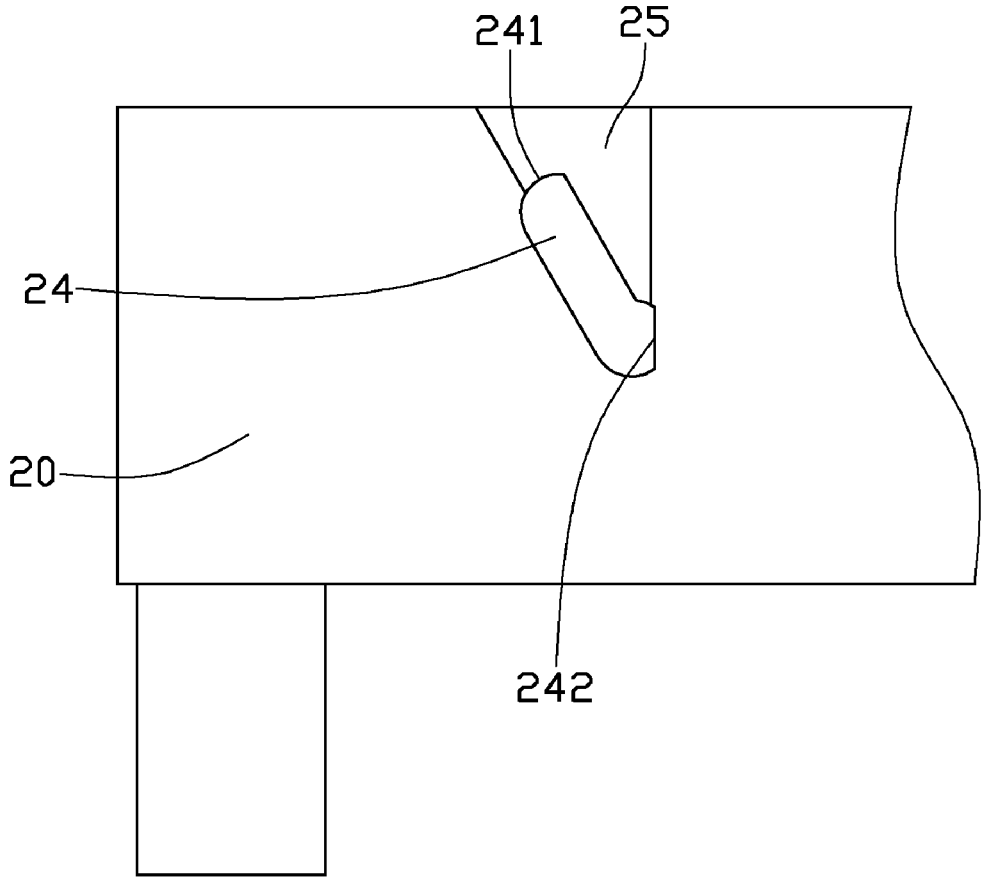
FIG. 3 is an enlarged plan view of a front side of part of an electrical connector of the mounting apparatus of FIG. 2.

Referring also to FIG. 3, two elongated sliding grooves 24 are defined in the opposite ends of the connector 20, corresponding to the two receiving grooves 232. Each sliding groove 24 perpendicularly extends through both the side surfaces 22. The two sliding grooves 24 intersect the two receiving grooves 232, respectively. Each sliding groove 24 has a top end adjacent to the top surface 21, and a bottom end far from the top surface 21. The connector 20 forms a first blocking portion 241 at the top end of each sliding groove 24, and a second blocking portion 242 at the bottom end of the sliding groove 24. Each sliding groove 24 extends downwardly and inwardly from the first blocking portion 241 towards the second blocking portion 242. The sliding groove 24 has a substantially uniform transverse width. However, the bottom end of the sliding groove 24 is somewhat enlarged. Each sidewall of the connector 20 defines two V-shaped recesses 25 therein, corresponding to the two sliding grooves 24, respectively. Each recess 25 has a small end adjacent to a corresponding sliding groove 24, and extends up from the sliding groove 24 to the top surface 21 of the connector 20.

Figure 4:
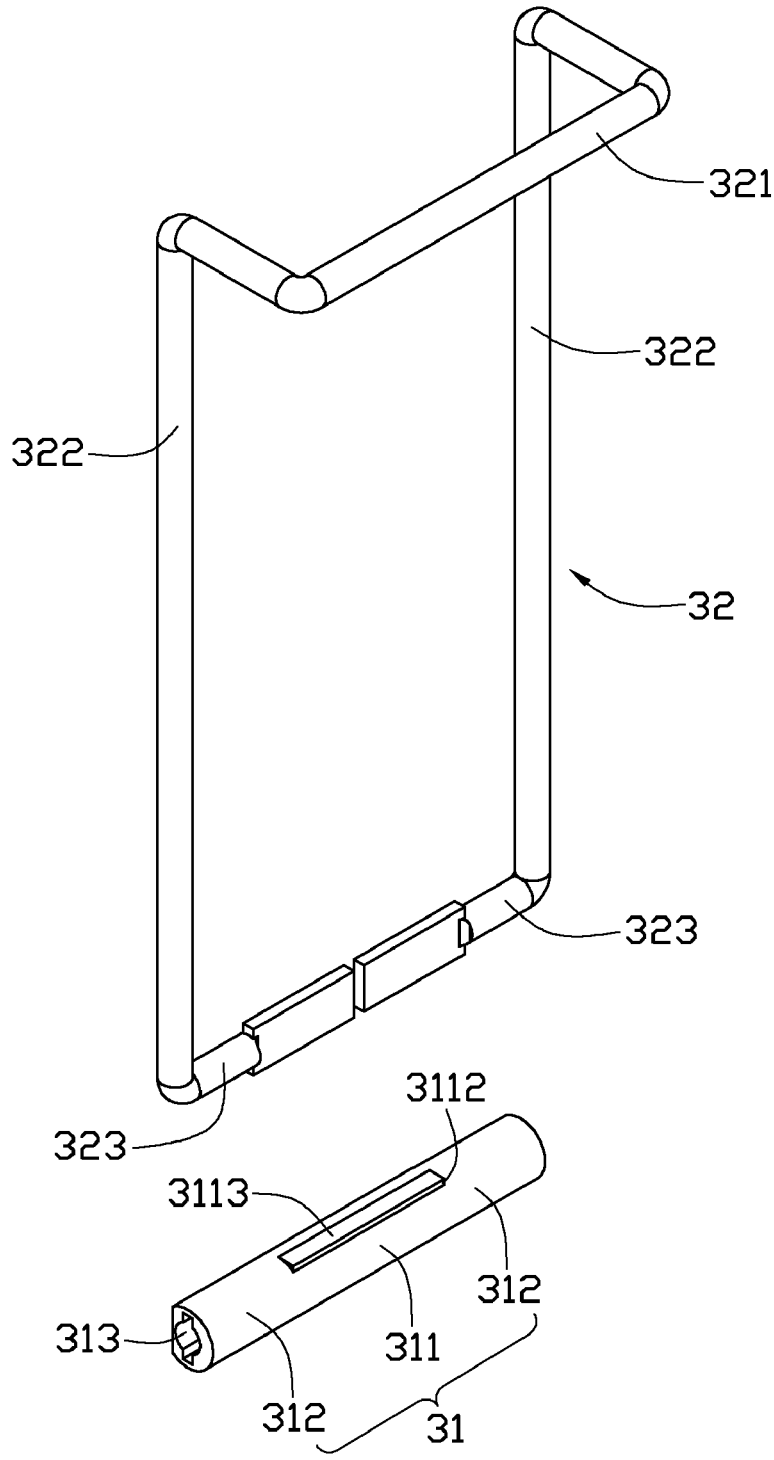
FIG. 4 is an enlarged, exploded view of a latching mechanism of the mounting apparatus of FIG. 2.
Figure 5:
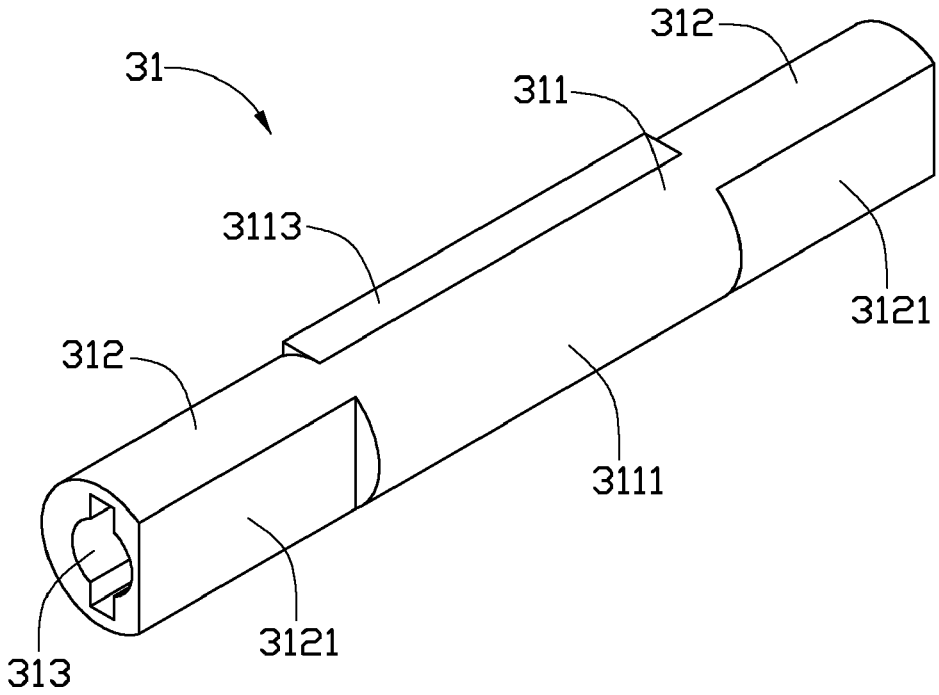
FIG. 5 is an isometric view of a guide pin of the latching mechanism of FIG. 4, viewed from another aspect.

Referring also to FIGS. 4-5, the two latching mechanisms 30 are connected to the two opposite ends of the connector 20. Each latching mechanism 30 includes a guide pin 31 and a latching member 32. The guide pin 31 is substantially columniform. The guide pin 31 includes a middle positioning section 311, and two pivot sections 312 at two ends of the positioning section 311, respectively. A length of the positioning section 311 is slightly shorter than the width of the corresponding receiving groove 232. Each pivot section 312 defines an indent plane 3121 in an outer peripheral surface thereof. Thereby, a positioning protrusion 3111 is formed on the positioning section 311, between the indent planes 3121 of the two pivot sections 312. In a direction perpendicular to the indent plane 3121 of the pivot section 312, a maximum diameter of the positioning section 311 is larger than that of the pivot section 312. The positioning section 311 further forms a protruding bar 3112 thereon. The protruding bar 3112 has an abutting plane 3113, which is perpendicular to the indent planes 3121 of the pivot sections 312. Further, the guide pin 31 defines two axial receiving holes 313 in two opposite ends thereof, respectively.

The latching member 32 includes a U-shaped latching portion 321, two feet 323, and two elongated connecting arms 322 respectively connecting the two feet 323 with two ends of the latching portion 321. The two connecting arms 322 extend perpendicularly (downwardly) from the two ends of the latching portion 321, respectively. That is, the connecting arms 322 are perpendicular to a plane in which the latching portion 321 is located. Each foot 323 extends perpendicularly inwardly (horizontally) from a bottom end of the corresponding connecting arm 322. That is, the feet 323 extend towards each other. In this embodiment, the latching member 32 is made of a single metal wire. When the two latching members 32 engage the opposite ends of the expansion card 10, the two latching members 32 may block airflow thereat only a little, thereby greatly enhancing dissipation of heat from the expansion card 10.

In assembly of the mounting apparatus, the guide pin 31 of each latching mechanism 30 is inserted in a corresponding sliding groove 24 of the connector 20, with the positioning section 311 of the guide pin 31 being received in the receiving groove 232 of the connector 20 to prevent the guide pin 31 from moving along an axial direction thereof. In this embodiment, the guide pin 31 is made of plastic. The positioning section 311 of the guide pin 31 can be inserted to the receiving groove 232 of the connector 20 by pressing. In other embodiments, the connector 20 can define an inserting hole therein for inserting the positioning section 311 of the guide pin 31 into the receiving groove 232 of the connector 20. Then, bottom ends of the two connecting arms 322 of the latching member 32 are pulled outwardly to make a distance between the two feet 323 greater than a length of the guide pin 31. Thus, the two feet 323 of the latching member 32 are firmly inserted into the receiving holes 313 of the guide pin 31 when the pulling force is released. Bottom ends of the connecting arms 322 of the latching member 32 are receiving in the recesses 25 of the connector 20, thereby limiting a range of rotation angles of the latching member 32.

Figure 6:
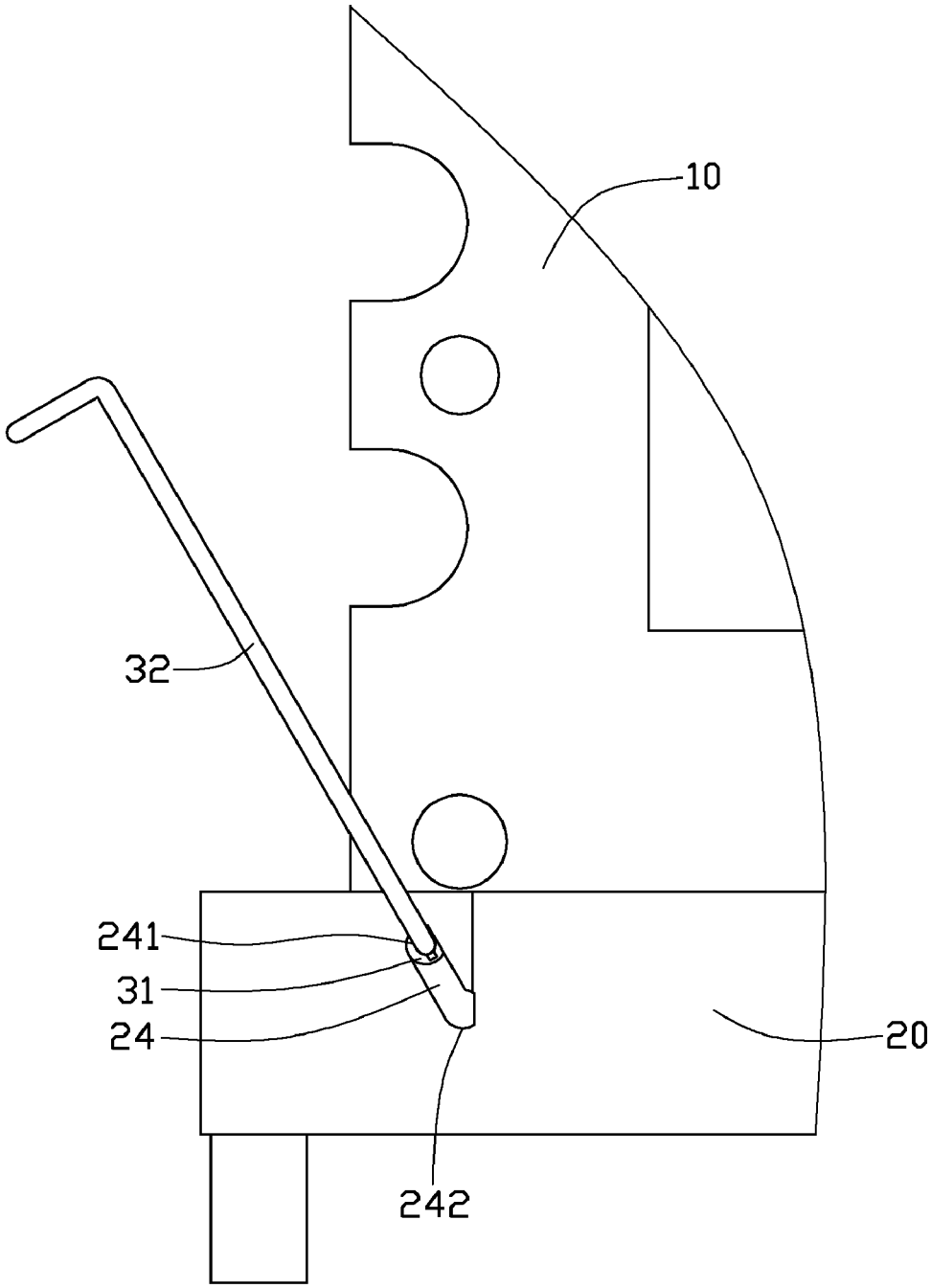
FIG. 6 is an enlarged plan view of a front side of part of the mounting apparatus of FIG. 1, but showing the expansion card not yet latched.
Figure 7:
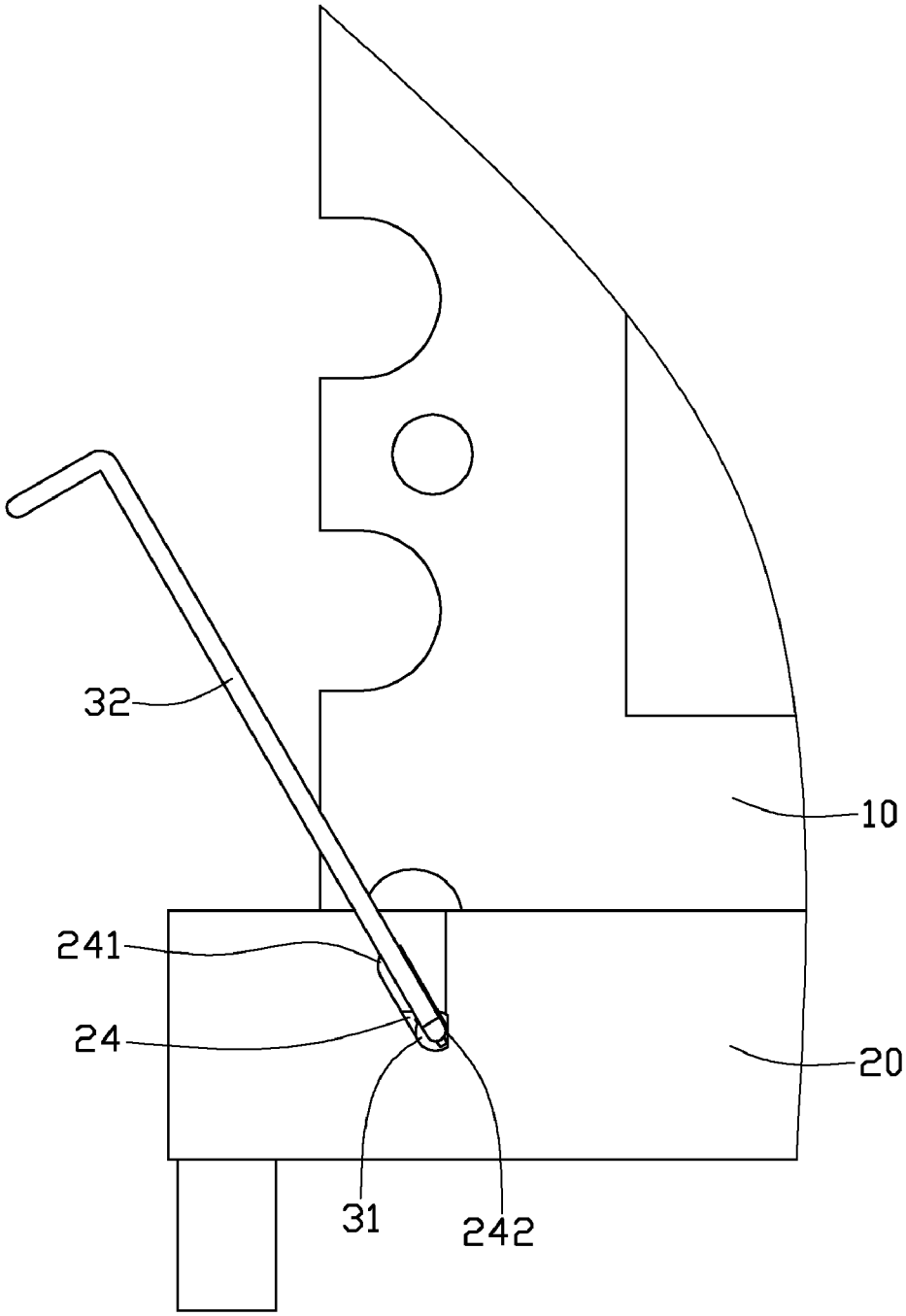
FIG. 7 is similar to FIG. 6, but shows a state of the mounting apparatus during latching of the expansion card.
Figure 8:
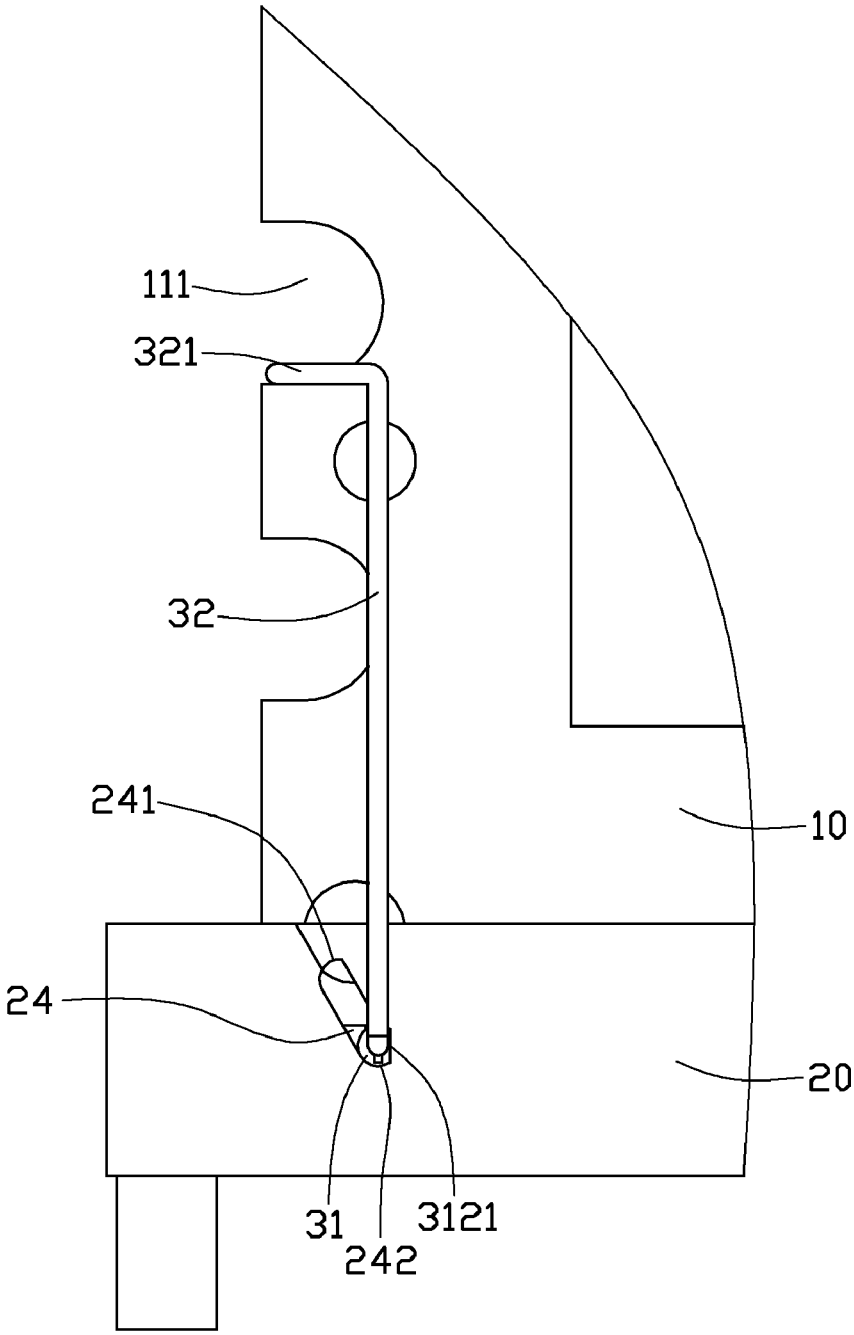
FIG. 8 is similar to FIG. 7, but shows the expansion card latched.

Referring to FIGS. 6-8, before the expansion card 10 is attached to the connector 20, the guide pin 31 of each latching mechanism 30 is located at the top end of the corresponding sliding groove 24 and abuts the first blocking portion 241 of the connector 20. The indent planes 3121 of the guide pin 31 are parallel to a long side of the sliding groove 24. At this time, the guide pin 31 cannot rotate relative to the connector 20 (FIG. 6).

In assembly of the expansion card 10 to the connector 20, the bottom portion of the expansion card 10 is aligned with the slot 23 of the connector 20. Then, the expansion card 10 is depressed. The guide pin 31 of each latching mechanism 30 is pushed by the expansion card 10 to move from the top end of the sliding groove 24 along the sliding groove 24 to the bottom end of the sliding groove 24 (FIG. 7). After the guide pin 31 of each latching mechanism 30 has reached the bottom end of the sliding groove 24, the latching portion 321 of the latching mechanism 30 is rotated (pushed) inwardly. This causes the guide pin 31 to rotate relative to the connector 20, and the latching portion 321 is rotated till the latching portion 321 is received in the recess 111 of the expansion card 10 (FIG. 8). At this time, the guide pin 31 abuts against the second blocking portion 242 of the connector 20. The indent planes 3121 of the guide pin 31 are oriented vertically. The abutting plane 3113 is oriented horizontally, and abuts against a bottom end of the expansion card 10. A maximum diameter of each pivot section 312 of the guide pin 31 as measured along a transverse width direction of the sliding groove 24 is greater than the transverse width of the sliding groove 24. Thereby, the guide pin 31 is prevented from moving upwardly along the sliding groove 24, unless the guide pin 31 is first rotated. Thus, the expansion card 10 is firmly mounted to the connector 20 by the two latching mechanisms 30.

When taking the expansion card 10 out from the slot 23 of the connector 20, the latching portion 321 of the latching member 32 of each latching mechanism 30 is rotated (pulled) outwardly, causing the guide pin 31 to rotate relative to the connector 20 till the indent planes 3121 of the guide pin 31 rotate to orientations parallel to the long side of the sliding groove 24. Then, the latching member 32 is pulled obliquely upwardly, causing the expansion card 10 move upwardly together with the guide pin 31. When the guide pin 31 of the latching mechanism 30 has reached the top end of the sliding groove 24, the bottom portion of the expansion card 10 has been substantially pulled out of the slot 23 of the connector 20. The expansion card 10 can then be easily taken out of the slot 23 of the connector 20.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A mounting apparatus comprising:

an electrical connector for mounting an expansion card thereon, the connector comprising a top surface and two opposite side surfaces extending downwardly from two opposite sides of the top surface, the connector defining a slot in the top surface thereof for engagingly receiving a bottom portion of the expansion card, the connector further defining two sliding grooves therein adjacent to two ends of the slot, respectively, each of the two sliding grooves extending though the two side surfaces of the connector; and two latching mechanisms connected to two opposite ends of the connector, each of the latching mechanisms comprising:

a guide pin slidably received in a corresponding sliding groove of the connector; and a latching member comprising a latching portion configured for detachably engaging with the expansion card, two feet connected to two ends of the guide pin, and two connecting arms each connected between one end of the latching portion and a corresponding one of the two feet;

wherein when the latching members are detached from the expansion card and the guide pins are pulled up by the latching members to move from bottom ends of the sliding grooves to top ends of the sliding grooves, the guide pins push the expansion card up out of the slot of the connector.

2. The mounting apparatus of claim 1, wherein the connector forms a first blocking portion at the top end of each sliding groove and a second blocking portion at the bottom end of the sliding groove, the sliding groove extending downwardly and inwardly from the first blocking portion towards the second blocking portion.

3. The mounting apparatus of claim 2, wherein the guide pins each comprises a middle positioning section and two pivot sections respectively at two ends of the positioning section, each of the two pivot sections defining an indent plane in an outer peripheral surface thereof.

4. The mounting apparatus of claim 3, wherein the bottom end of the sliding groove has a dimension greater than that of the top end of the sliding groove, when the guide pin is located at the bottom end of the sliding groove, the guide pin rotates relative to the connector to a predetermined position to preventing the guide pin from moving upwardly along the sliding groove.

5. The mounting apparatus of claim 3, wherein a positioning protrusion is formed on the position section and located between the indent planes of the two pivot sections, two receiving grooves being in the top surface of the connector and respectively located at two opposite ends of the slot, the positioning protrusion of the positioning section of the guide pin being received in a corresponding groove to prevent the guide pin from move along an axial direction thereof.

6. The mounting apparatus of claim 3, wherein the positioning section of the guide pin forms a protruding bar thereon, the protruding bar having an abutting plane configured for abutting a bottom end of the expansion card.

7. The mounting apparatus of claim 1, wherein each sidewall of the connector defines two V-shaped recesses therein corresponding to the two sliding grooves, respectively, each recess having a small end adjacent to a corresponding sliding groove, and extending from the corresponding sliding groove up to the top surface of the connector.

8. The mounting apparatus of claim 1, wherein the latching portion of the latching member is U-shaped.

9. The mounting apparatus of claim 8, wherein the two connecting arms extend downwardly from two opposite ends of the latching portion respectively, and are perpendicular to a plane on which the latching portion is to be located.

10. The mounting apparatus of claim 1, wherein the latching member is made of metal wire.

11. A mounting apparatus comprising:

an elongated electrical connector for mounting an expansion card thereon, the connector comprising a top surface and two opposite surfaces extending downwardly from two opposite sides of the top surface, the connector defining a slot in the top surface thereof for engagingly receiving a bottom portion of the expansion card, the connector further defining two sliding grooves therein adjacent to two ends of the slot, respectively, each of the two sliding grooves extending though the two side surfaces of the connector; and two latching mechanisms connected to two opposite ends of the connector, each of the latching mechanisms comprising:

a guide pin received in a corresponding sliding groove of the connector; and a latching member connecting with two opposite ends of the guide pin, the latching member comprising a latching portion configured for detachably engaging with the expansion card;

wherein when the guide pins are located at bottom ends of the sliding grooves and the latching members are engaged with the expansion card, the guide pins are fittingly held in the bottom ends of the sliding grooves;

when the latching members are rotated away from and thereby detached from the expansion card, the latching members simultaneously rotate the guide pins such that the guide pins become slidable in the sliding grooves; and when the latching members are pulled obliquely upwardly they drive the guide pins to slide from the bottom ends of the sliding grooves to top ends of the sliding grooves such that the guide pins push the expansion card out of the slot of the connector.

12. The mounting apparatus of claim 11, wherein the bottom end of the sliding groove has a dimension greater than that of the top end of the sliding groove, when the guide pin is located at the bottom end of the sliding groove, the guide pin rotates relative to the connector to a predetermined position to preventing the guide pin from moving upwardly along the sliding groove.

13. The mounting apparatus of claim 12, wherein the connector forms a first blocking portion at the top end of each sliding groove and a second blocking portion at the bottom end of the sliding groove, the sliding groove extending downwardly and inwardly from the first blocking portion towards the second blocking portion.

14. The mounting apparatus of claim 12, wherein the guide pins each comprises a middle positioning section and two pivot sections respectively at two ends of the positioning section, each of the two pivot sections defining an indent plane in an outer peripheral surface thereof.

15. The mounting apparatus of claim 14, wherein the bottom end of the sliding groove has a dimension greater than that of the top end of the sliding groove, when the guide pin is located at the bottom end of the sliding groove, the guide pin rotates relative to the connector to a predetermined position to preventing the guide pin from moving upwardly along the sliding groove.

16. The mounting apparatus of claim 14, wherein a positioning protrusion is formed on the position section and located between the indent planes of the two pivot sections, two receiving grooves being in the top surface of the connector and respectively located at two opposite ends of the slot, the positioning protrusion of the positioning section of the guide pin being received in a corresponding groove to prevent the guide pin from move along an axial direction thereof.

17. The mounting apparatus of claim 14, wherein the positioning section of the guide pin forms a protruding bar thereon, the protruding bar having an abutting plane configured for abutting a bottom end of the expansion card.

18. The mounting apparatus of claim 11, wherein each sidewall of the connector defines two V-shaped recesses therein corresponding to the two sliding grooves, respectively, each recess having a small end adjacent to a corresponding sliding groove, and extending from the corresponding sliding groove up to the top surface of the connector.

19. The mounting apparatus of claim 11, wherein the latching member is made of metal wire, the latching member further comprising two feet connected to two ends of the guide pin, and two connecting arms each connected between one end of the latching portion and a corresponding one of the two feet.

20. The mounting apparatus of claim 19, wherein the latching portion of the latching member is U-shaped.

* * * * *